US012428197B1

(12) United States Patent
Welch

(10) Patent No.: US 12,428,197 B1
(45) Date of Patent: Sep. 30, 2025

(54) SPORT DRINK BOTTLE WITH ARM SHAPED HANDLE

(71) Applicant: Robert Welch, Valrico, FL (US)

(72) Inventor: Robert Welch, Valrico, FL (US)

( * ) Notice: Subject to any disclaimer, the term of this patent is extended or adjusted under 35 U.S.C. 154(b) by 136 days.

(21) Appl. No.: 18/372,304

(22) Filed: Sep. 25, 2023

(51) Int. Cl.

| | |
|---|---|
| ***B65D 21/02*** | (2006.01) |
| ***A45F 5/10*** | (2006.01) |
| ***B65D 1/04*** | (2006.01) |
| ***B65D 23/10*** | (2006.01) |
| ***B65D 23/12*** | (2006.01) |
| ***B65D 47/28*** | (2006.01) |
| ***B65D 81/32*** | (2006.01) |

(52) U.S. Cl.
CPC ..... *B65D 21/0237* (2013.01); *B65D 1/04* (2013.01); *B65D 23/104* (2013.01); *B65D 23/12* (2013.01); *B65D 47/283* (2013.01); *B65D 81/3205* (2013.01); *A45F 2005/1086* (2013.01)

(58) Field of Classification Search
CPC .... B65D 81/3205; B65D 1/04; B65D 23/104; B65D 23/12; B65D 21/0237; A45F 2005/1086; A45F 2005/108
USPC ..... 215/396, DIG. 8, 6; 220/23.2; 206/822; D7/517, 520, 533, 534, 535, 544
See application file for complete search history.

(56) References Cited

U.S. PATENT DOCUMENTS

| | | | | |
|---|---|---|---|---|
| 2,274,973 | A * | 3/1942 | Bryant | A47J 41/02 215/396 |
| 2,744,649 | A * | 5/1956 | Smith | B65D 23/12 215/390 |
| 4,257,525 | A * | 3/1981 | Thompson | B65D 23/102 215/396 |
| 7,798,346 | B2 | 9/2010 | Nelson | |
| D664,397 | S * | 7/2012 | Franco | D7/517 |
| D816,413 | S * | 5/2018 | Kramer | D7/579 |
| 10,287,084 | B2 * | 5/2019 | Yahalom | B65D 21/0233 |
| 10,427,825 | B2 | 10/2019 | Buehrle | |
| 2005/0067414 | A1 * | 3/2005 | Lipson | B65D 1/04 220/23.89 |
| 2014/0360908 | A1 * | 12/2014 | Sorensen | B65D 51/28 206/501 |
| 2017/0105581 | A1 * | 4/2017 | Enghard | B65D 41/04 |

* cited by examiner

*Primary Examiner* — Nathan J Jenness
*Assistant Examiner* — Jennifer Castriotta
(74) *Attorney, Agent, or Firm* — Sanchelima & Associates, P.A.; Jesus Sanchelima; Christian Sanchelima

(57) ABSTRACT

A sport drink bottle with arm shaped handle including a bottle assembly, a lid assembly and a container assembly. The bottle assembly includes a bottle having a receiving portion formed in a lateral side thereof. The bottle is hollow. The lid assembly includes a bottle lid threadably attached to an open top of the bottle. The container assembly includes a container. The container is threadably attached to the receiving portion defining an attached and detached configuration. The container includes a container lid to access a content of the container. The container is used as a handle of the bottle in the attached configuration.

9 Claims, 4 Drawing Sheets

SPORT DRINK BOTTLE WITH ARM SHAPED HANDLE

BACKGROUND OF THE INVENTION

1. Field of the Invention

The present invention relates to a sport drink bottle with arm shaped handle and, more particularly, to a sport drink bottle with arm shaped handle that allows storing liquid and solid elements.

2. Description of the Related Art

Several designs for sport drink bottles have been designed in the past. None of them, however, include a compartment having a lid, where the compartment is suitable to store powder or pills therein.

Applicant believes that a related reference corresponds to U.S. Pat. No. 7,798,346 issued for a beverage bottle or the like that includes a removable secondary container for storing a drink concentrate mixture. Applicant believes that another related reference corresponds to U.S. Pat. No. 10,427,825 issued for a canteen or water bottle with an integrally formed storage compartment for small articles. None of these references, however, teach of a beverage bottle comprising a reusable bottle with a detachable handle, wherein the handle is hollow and is formed in the shape of a human arm. The handle includes a removable lid and is configured to contain a powdered drink mixture.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a sports drink bottle with arm shaped handle that includes a handle to easily hold and carry the bottle.

It is another object of this invention to provide a sport drink bottle with arm shaped handle that includes a bottle with a removable lid to introduce liquid therein.

It is still another object of the present invention to provide a sport drink bottle with arm shaped handle that includes a bottle having an inserting portion suitable to receive the arm shaped handle.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
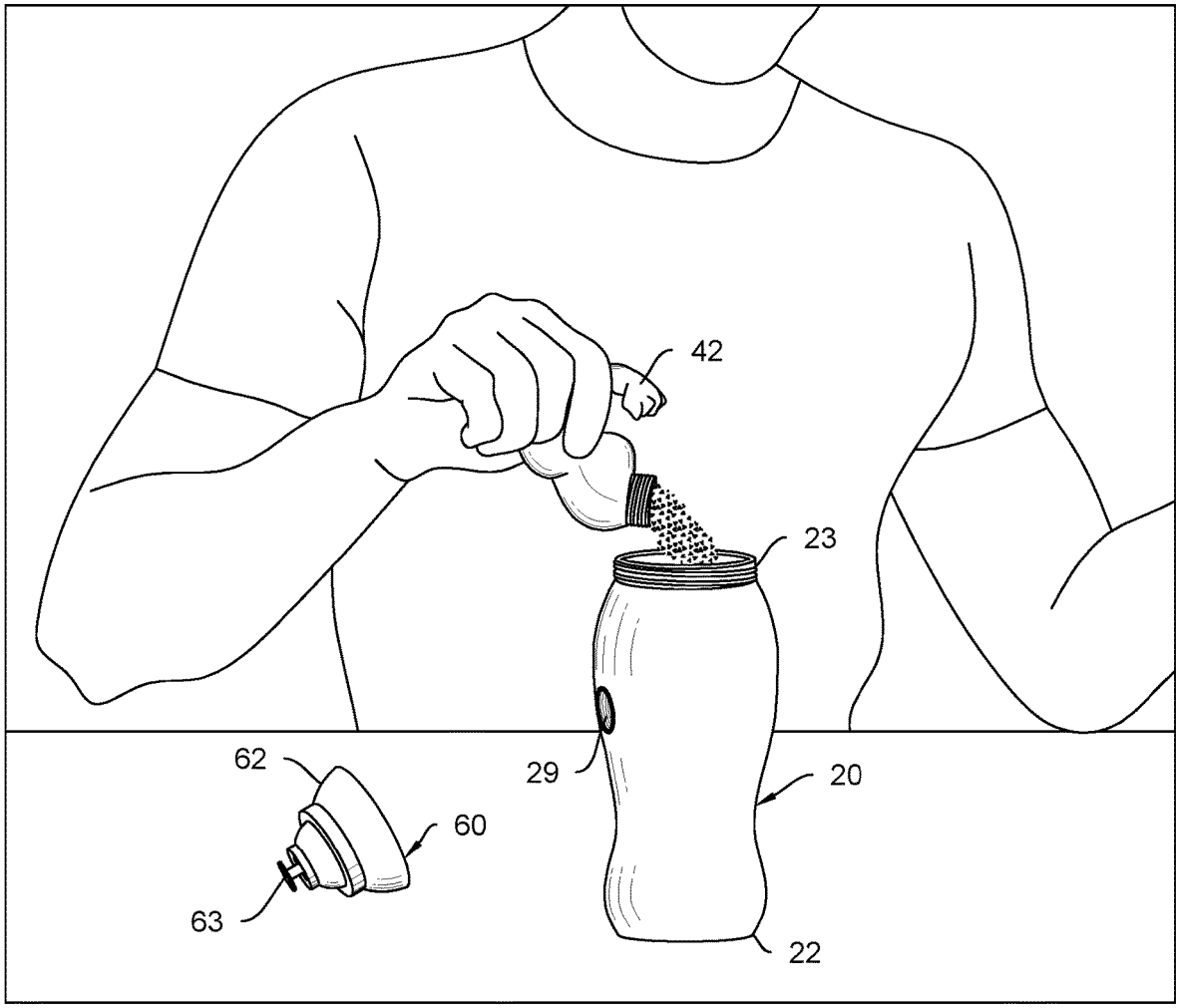
FIG. 1 represents an isometric operational view of the present invention 10 where user deposits content of the container 42.

Referring now to the drawings, where the present invention is generally referred to with numeral 10, it can be observed that it basically includes a bottle assembly 20 a container assembly 40 and a lid assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
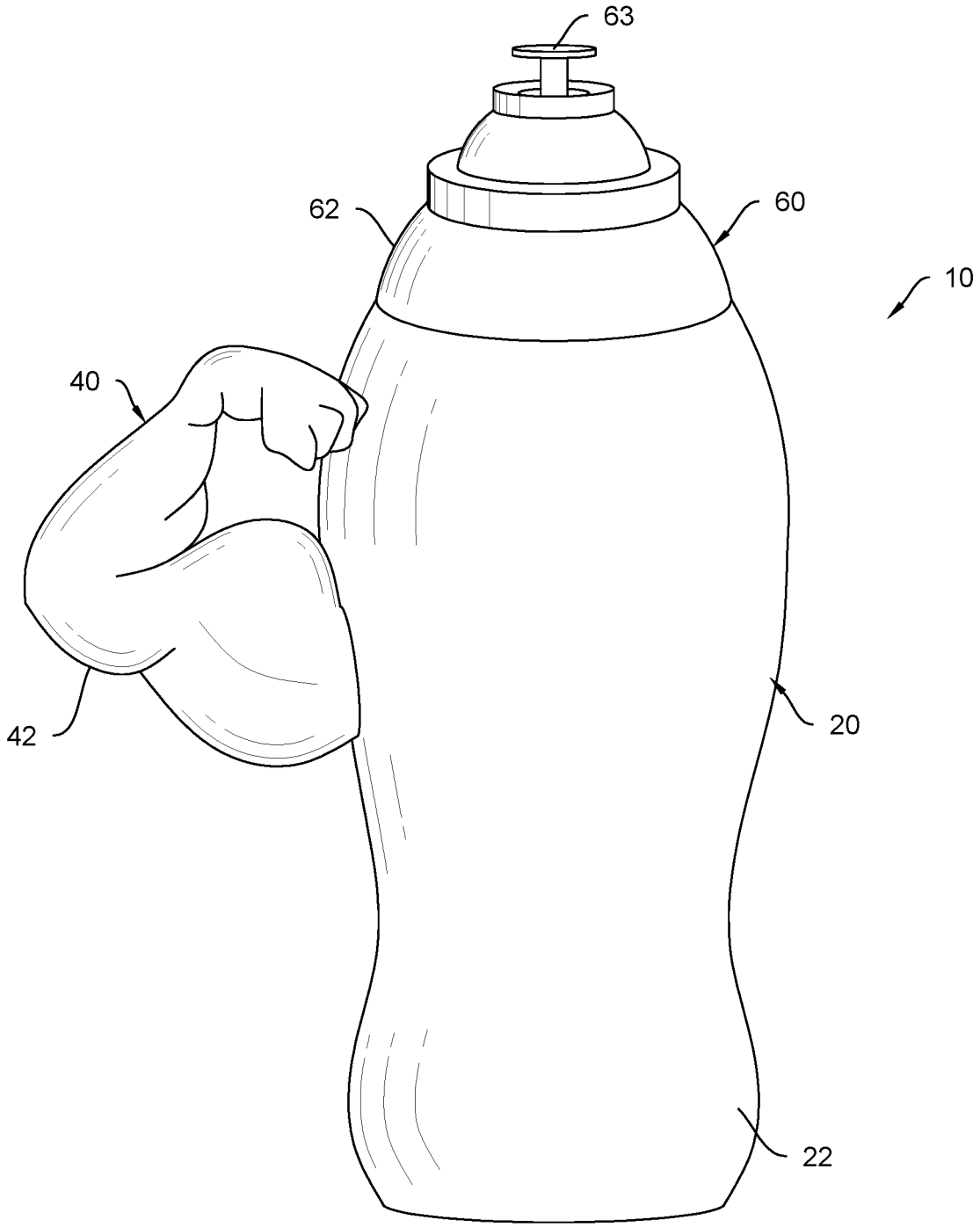
FIG. 2 shows an isometric operational view of the present invention 10. The present invention includes a container assembly 40 removable attached to a side of a bottle assembly 20 having a lid assembly 60.

The bottle assembly 20 may include a bottle 22 having a threaded portion 23 and a receiving portion 29. The bottle 22 may substantially have a cylindrical shape with curved top and bottom defining a sinusoidal profile, as best shown in FIG. 2. It also may be suitable for bottle 22 to have a rectangular shape, an elliptical shape, a triangular shape, or any other shape. The bottom end of the bottle 22 may be planar to allow the bottle 22 to stand in an upright position. In a preferred embodiment the bottle 22 may be made of a transparent plastic. It also may be suitable for the bottle 22 to be made of aluminum, iron steel, or any other suitable material. The bottle 22 may be suitable to receive and store a liquid therein. The bottle 22 may have an open top end. The open top end of the bottle 22 may have the threaded portion 23 about an external circumference thereof, defining a male threaded end.

Figure 3:
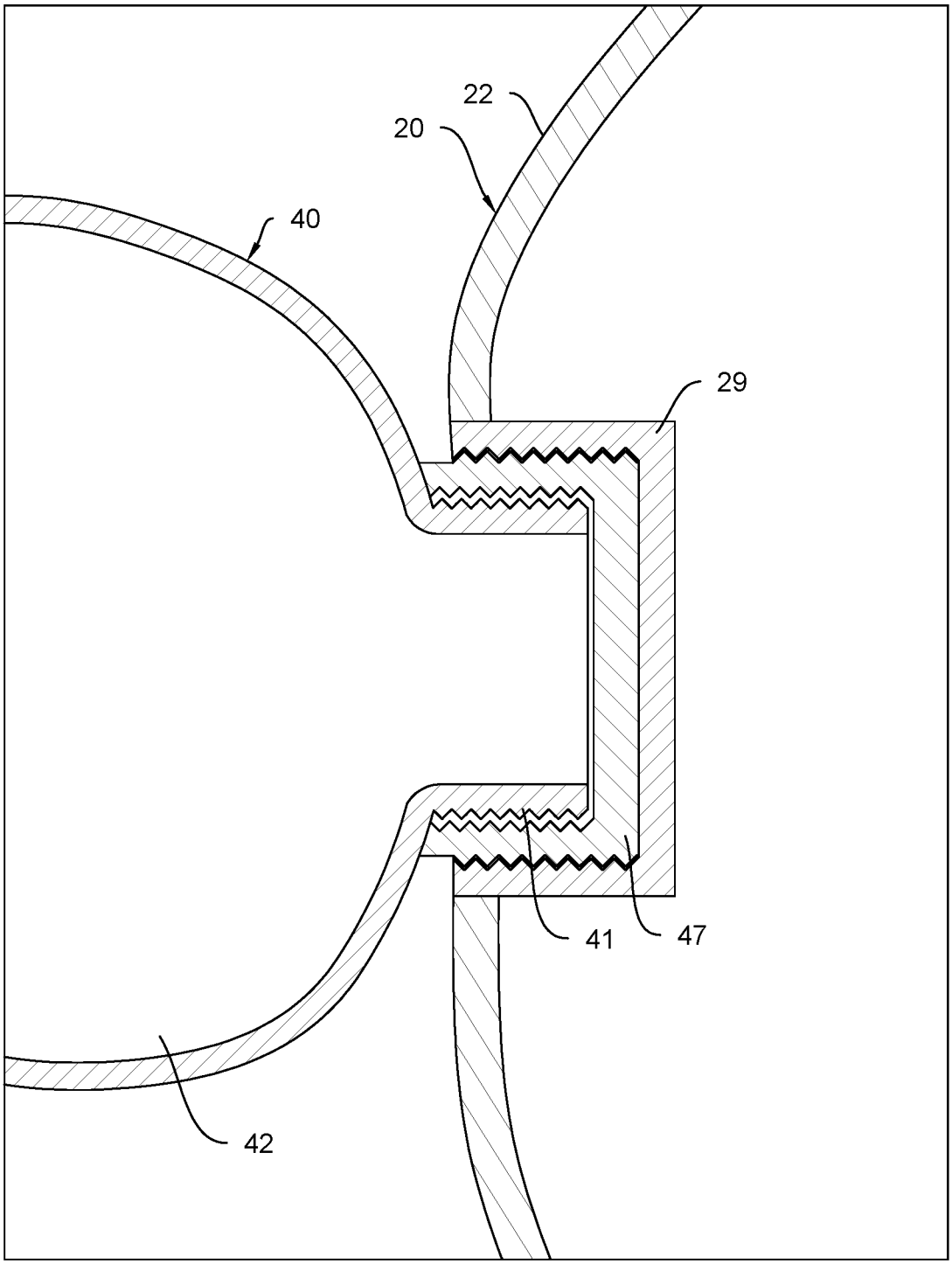
FIG. 3 illustrates a cross-sectional enlarged view of the junction between container lid 47 and receiving portion 29.
Figure 4:
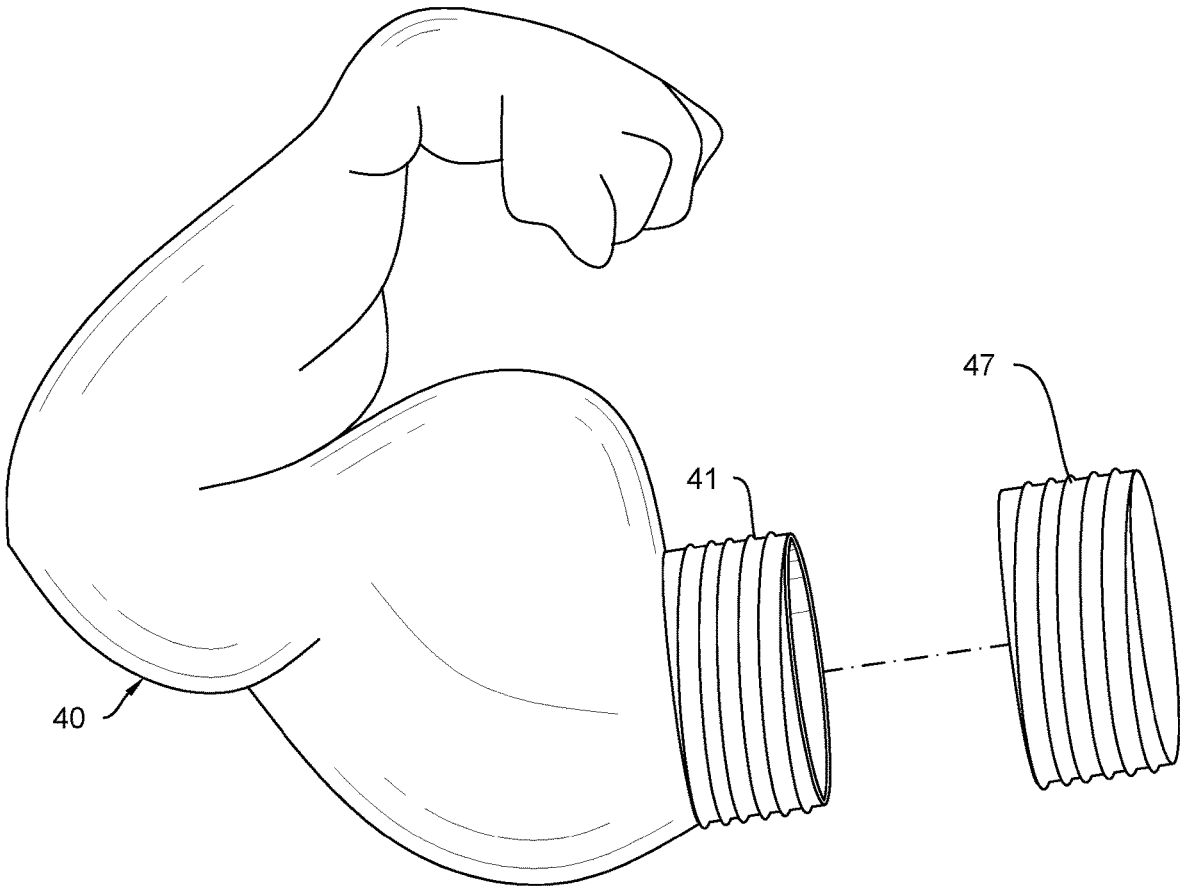
FIG. 4 is an isometric enlarged view of the lid 47.

Referring now to FIG. 1 and FIG. 3, it can be illustrated that the receiving portion 29 may be an opening on one of the sides of bottle 22. The receiving portion 29 may include a bottom wall, threaded sidewalls and a bottom end, defining a female threaded opening. The receiving portion 29 may be adapted to receive a male threaded member. In a preferred embodiment, the receiving portion 29 may have a cylindrical shape.

As best illustrated in FIG. 3 the container assembly 40 may include a container 42, a container threaded portion 41, and a container lid 47. The container 42 may have a curved shape. The container 42 may be hollow. In a preferred embodiment the container 42 may have a shape that conforms to the shape of a bent arm. It also may be suitable for the container 42 to have a rectangular shape, a circular shape, or any other suitable shape. The container 42 may be removable attached to the bottle 22. The container 42 may have a portion vented diagonally upwards. When the container 42 is attached to the bottle 22 the container 42 may be used as a handle to hold the bottle 22. The container 42 may be used to store any material therein and dispense the material through removal of the container lid 47. The container 42 and the container lid 47 may be made of the same material as the bottle 22. The container 42 may have an male threaded neck.

The container lid 47 may have an inner thread and an outer thread. The inner thread of the container lid 47 may be coupled with the male threaded neck of the container 42. The outer container thread of the container lid 47 may be coupled with the receiving portion 29. In a closed configuration, the container lid 47 may be threadable attached to the container 42 and the container 42 may be threadably attached to the bottle 22 through the receiving portion 29. It should be noticed that in an open configuration the container lid 47 may be removed for accessing the content of the container 42.

The lid assembly 60 may include a lid 62 having a gate 63. The lid 62 may be threadably attached to the open top end of the bottle 22. The lid 62 may substantially have a conical tapered shape. It also may be suitable for the lid 62 to have a cylindrical shape, a rectangular shape, or any other suitable shape. The lid 62 may be made of the same material as the material of the bottle 22. The gate 63 may be moved down and up to permit flow of water from a top portion of the lid 62.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A sport drink bottle with arm shaped handle, comprising:

a bottle assembly, wherein said bottle assembly includes a bottle having a receiving portion formed in a lateral side thereof, wherein said bottle is hollow;

a lid assembly, wherein said lid assembly includes a bottle lid threadably attached to an open top end of the bottle; and a container assembly, wherein said container assembly includes a container, said container being threadably and removably attached to said bottle by means of the receiving portion defining an attached configuration and a detached configuration, wherein said container includes a container lid to allow access to a content of said container, wherein said container is configured to have a bent-arm shape, said container being the bottle's handle in said attached configuration.

2. The sport drink bottle with arm shaped handle set forth in claim 1, wherein said receiving portion is a female threaded opening.

3. The sport drink bottle with arm shaped handle set forth in claim 1, wherein said container lid has an inner threaded portion and an outer threaded portion, wherein said outer threaded portion is configured to be coupled with said receiving portion.

4. The sport drink bottle with arm shaped handle set forth in claim 1, wherein said receiving portion has a circular shape.

5. The sport drink bottle with arm shaped handle set forth in claim 1, wherein said container and said bottle are made of a transparent plastic.

6. The sport drink bottle with arm shaped handle set forth in claim 1, wherein said container is hollow.

7. The sport drink bottle with arm shaped handle set forth in claim 1, wherein said bottle lid includes a gate member, said gate member is operated to permit flow of liquid through a top portion of the bottle lid.

8. A sport drink bottle with arm shaped handle, comprising:

a bottle assembly, wherein said bottle assembly includes a bottle having a receiving portion formed in a lateral side thereof, wherein said receiving portion is a female threaded opening, wherein said bottle is hollow;

a lid assembly, wherein said lid assembly includes a bottle lid threadably attached to an open top end of the bottle; and a container assembly, wherein said container assembly includes a container, said container being threadably and removably attached to said bottle by means of the receiving portion defining an attached configuration and a detached configuration, wherein said container includes a container lid to allow access to a content of said container, wherein said container lid has an inner threaded portion and an outer threaded portion, wherein said outer threaded portion is configured to be coupled with said receiving portion wherein said container is said arm shaped handle of said bottle in said attached configuration.

9. A sport drink bottle with bent-arm shaped handle, consisting of:

a bottle assembly, wherein said bottle assembly includes a bottle having a receiving portion formed in a lateral side thereof, wherein said receiving portion is a female threaded opening, wherein said bottle is hollow;

a lid assembly, wherein said lid assembly includes a bottle lid threadably attached to an open top end of the bottle, wherein said bottle lid includes a gate member, said gate member is operated to permit flow of liquid through a top portion of the bottle lid; and a container assembly, wherein said container assembly includes a container, wherein said container is configured to have a bent-arm shape, said container is hollow, said container being threadably and removably attached to said bottle by means of the receiving portion defining an attached configuration and a detached configuration, wherein said container includes a container lid to allow access to a content of said container, wherein said container lid has an inner threaded portion and an outer threaded portion, wherein said outer threaded portion is configured to be coupled with said receiving portion wherein said container is said bent-arm shaped handle of said bottle in said attached configuration, said container having a male threaded opening where the container lid is attached thereto, wherein said container and said bottle are made of a transparent plastic.

* * * * *